US010021972B1

(12) United States Patent
Robinson et al.

(10) Patent No.: US 10,021,972 B1
(45) Date of Patent: Jul. 17, 2018

(54) CANTILEVER SHELVING SYSTEM

(71) Applicant: InterMetro Industries Corporation, Wilkes-Barre, PA (US)

(72) Inventors: Todd Robinson, Nazareth, PA (US); Sushant Ramchandra Parekar, Pune (IN)

(73) Assignee: InterMetro Industries Corporation, Wilkes-Barre, PA (US)

( * ) Notice: Subject to any disclaimer, the term of this patent is extended or adjusted under 35 U.S.C. 154(b) by 0 days.

(21) Appl. No.: 15/884,523

(22) Filed: Jan. 31, 2018

(30) Foreign Application Priority Data

Feb. 17, 2017 (IN) ..... 201721005649

(51) Int. Cl.
*A47B 43/00* (2006.01)
*A47B 47/02* (2006.01)
(Continued)

(52) U.S. Cl.
CPC ..... *A47B 47/022* (2013.01); *A47B 47/028* (2013.01); *A47B 57/487* (2013.01); *A47B 96/061* (2013.01); *A47B 57/06* (2013.01)

(58) Field of Classification Search
CPC ..... A47B 57/06; A47B 47/022; A47B 47/028; A47B 57/487; A47B 96/061
(Continued)

(56) References Cited

U.S. PATENT DOCUMENTS 291,030 A * 1/1884 Clapper ..... A47B 57/04 108/1
309,360 A * 12/1884 Roberts ..... A47B 57/26 108/106
(Continued)

FOREIGN PATENT DOCUMENTS

| | | |
|---|---|---|
| DE | 2824605 | 12/1979 |
| DE | 20215552 | 2/2003 |
| GB | 608480 | 9/1948 |
| WO | WO95/029613 | 11/1995 |
| WO | WO03/088782 | 10/2003 |
| WO | WO2013/071977 | 5/2013 |

OTHER PUBLICATIONS

Corrosion Resistant Cantilever Rack—Adjustable Width Uprights & Frame (Only); https://www.globalindustrial.com/p/storage/bulk-rack/cantilever/corrosion-resistant-cantilever-rack-upright; Global Industrial website; Circa 2011.
Cantilever Shelving Unit Assembly Instructions; Nexel Industries; Circa 2011.
(Continued)

*Primary Examiner* — Abigail E Troy
*Assistant Examiner* — Devin K Barnett
(74) *Attorney, Agent, or Firm* — Harness, Dickey & Pierce, P.L.C.

(57) ABSTRACT

A cantilever shelving system is disclosed and can include a frame structure, a cantilever shelf support structure, and a plurality of load-bearing shelves that can be supported by the cantilever shelf support structure and the frame structure. The shelves can be positioned laterally adjacent to cantilever support arms of the cantilever shelf support structure, and the shelf support surfaces can be coplanar with upper walls of the cantilever support arms. Ends of laterally adjacent shelves do not overlap with a front side of a vertical support member to which the cantilever support arm is mounted. The cantilever shelving system can accommodate various user requirements over known shelf systems and can be operably integrated with standard industrial and/or commercial machinery or equipment with which it may be used.

15 Claims, 9 Drawing Sheets

(51) Int. Cl.
*A47B 57/48* (2006.01)
*A47B 96/06* (2006.01)
*A47B 57/06* (2006.01)

(58) Field of Classification Search
USPC ..... 211/90.01–90.03, 186, 187, 188, 134; 248/236, 235, 240–247, 250.678, 346.01; 108/106–108, 147.11
See application file for complete search history.

(56) References Cited

U.S. PATENT DOCUMENTS 663,784 A * 12/1900 Porter ..... A47B 96/061 248/241
870,439 A * 11/1907 Kade ..... A47B 57/42 248/243
1,560,122 A 11/1925 Vance
1,582,100 A * 4/1926 Troppman ..... B24B 13/00 144/286.1
1,620,841 A 3/1927 Vance
1,698,974 A 1/1929 Vance
1,983,858 A 12/1934 Karnes
2,008,180 A 7/1935 Karnes
2,534,952 A * 12/1950 Comer ..... A47B 57/42 108/107
2,693,884 A 11/1954 Gurries
2,772,846 A * 12/1956 Skar ..... A47B 57/42 211/134
2,912,119 A 11/1959 Robinson
2,919,034 A * 12/1959 Levy ..... A47B 57/045 108/1
2,933,196 A * 4/1960 Childs ..... A47B 57/42 211/183
2,940,603 A 6/1960 Riedmaier
2,971,805 A * 2/1961 Weiss ..... A47F 5/103 108/185
2,975,908 A 3/1961 Huet
2,983,389 A * 5/1961 Trautmann ..... A47B 37/00 108/102
3,018,900 A 1/1962 Huet
RE25,156 E * 4/1962 Gingher ..... A47B 47/022 108/186
3,040,905 A 6/1962 Gingher et al.
3,044,632 A * 7/1962 Schild ..... A47B 57/425 108/108
3,044,634 A * 7/1962 Oztekin ..... A47B 96/02 108/108
3,057,483 A 10/1962 Derman
3,097,822 A * 7/1963 Attwood ..... A47B 57/045 248/250
3,127,146 A * 3/1964 Fisher ..... A47B 57/42 248/250
3,130,693 A * 4/1964 Shell ..... A47B 57/045 108/108
3,184,068 A 5/1965 Wende
3,199,822 A 8/1965 Ruhnke
3,207,322 A * 9/1965 Pedersen ..... A47B 57/485 108/106
3,212,648 A 10/1965 Baker, Jr. et al.
3,216,377 A 11/1965 Gunn
3,221,678 A * 12/1965 Doherty ..... A47B 57/26 108/106
3,229,822 A * 1/1966 Janus ..... A47B 57/04 211/134
3,316,863 A 5/1967 Zock
3,471,112 A * 10/1969 MacDonald ..... A47B 96/063 108/109
3,512,654 A 5/1970 Olsen et al.
3,556,306 A * 1/1971 Shell ..... A47B 96/027 108/108
3,565,020 A * 2/1971 Schier ..... A47B 96/028 108/152
3,587,867 A * 6/1971 Fenwick ..... A47F 5/103 211/183
3,595,404 A * 7/1971 Goldstein ..... A47F 5/0031 211/106
3,602,159 A 8/1971 Marschak
3,602,374 A 8/1971 Alabaster
3,612,291 A * 10/1971 Skubic ..... A47B 47/022 211/208
3,645,486 A * 2/1972 Ferdinand ..... A47B 57/30 108/108
3,695,569 A * 10/1972 Pullan ..... A47B 96/061 248/235
3,701,325 A 10/1972 Fenwick
3,730,108 A * 5/1973 Stroh ..... A47B 45/00 108/108
3,759,191 A * 9/1973 Freeman ..... A47B 57/30 108/109
3,765,344 A 10/1973 Ferdinand et al.
3,827,377 A * 8/1974 Aughtry, Jr. ..... A47F 5/103 108/108
3,854,686 A 12/1974 Konstant
4,018,167 A 4/1977 Spangler
4,064,996 A 12/1977 Shillum
4,098,480 A 7/1978 Neumann
4,101,108 A * 7/1978 Klein ..... A47B 57/40 248/223.31
4,197,950 A * 4/1980 Ovitz, III ..... A47F 7/163 211/134
4,230,052 A 10/1980 Champagne
4,286,719 A 9/1981 Hall
4,312,086 A * 1/1982 Bianco ..... A47B 83/00 108/108
4,332,204 A * 6/1982 Hewell ..... A47F 5/12 108/1
4,360,181 A * 11/1982 Burkholder ..... A47B 96/061 108/108
4,378,925 A * 4/1983 Griffin ..... A47B 57/045 108/108
4,390,302 A 6/1983 Sanfeliu-Marimon
4,396,125 A 8/1983 Rowader
4,397,432 A * 8/1983 Resetar ..... B64D 11/00 211/193
4,444,323 A 4/1984 Travis
4,592,286 A * 6/1986 Trubiano ..... A47B 57/545 108/108
4,624,376 A 11/1986 Bertram
4,938,442 A 7/1990 Mastrodicasa
4,951,908 A * 8/1990 Kallio ..... A47B 96/061 108/108
4,960,210 A * 10/1990 Spamer ..... A47F 5/005 211/183
5,022,541 A * 6/1991 White ..... A47F 5/103 108/108
5,054,404 A * 10/1991 Melgers ..... A47B 47/04 108/107
5,074,422 A * 12/1991 Holtz ..... A47B 57/10 108/108
D331,873 S 12/1992 Finkelstein et al.
5,269,419 A * 12/1993 Aldeguer ..... A47B 87/0223 108/180
5,297,486 A * 3/1994 Herrmann ..... A47B 96/028 108/108
5,350,074 A * 9/1994 Rosenband ..... A47B 47/021 211/191
5,365,860 A * 11/1994 Billington, III ..... A47C 9/025 108/108
5,405,114 A * 4/1995 Dias ..... A47B 96/061 108/108
D358,321 S 5/1995 Tayar
5,437,426 A * 8/1995 MacDonald ..... A47B 57/408 248/222.13
5,454,638 A 10/1995 Bird et al.
5,456,435 A 10/1995 Sweeney
5,472,103 A * 12/1995 Merl ..... A47B 47/022 211/187
5,482,168 A 1/1996 Welch et al.
5,522,324 A 6/1996 van Gelder et al.

(56) References Cited

U.S. PATENT DOCUMENTS 5,531,168 A 7/1996 Towfigh
5,592,886 A 1/1997 Williams et al.
5,605,238 A * 2/1997 Jacobs ..... A47B 47/0091 108/180
5,611,440 A * 3/1997 Møller ..... A47B 45/00 108/181
5,613,449 A 3/1997 Pullman
5,645,257 A 7/1997 Ward
5,655,740 A 8/1997 Lazarus
5,695,163 A 12/1997 Tayar
5,794,902 A 8/1998 Henry et al.
5,797,501 A * 8/1998 Von Gunten ..... A47B 57/42 108/180
5,833,083 A * 11/1998 Miller ..... D06F 57/00 211/134
5,868,263 A * 2/1999 McAllister ..... A47B 57/485 108/108
5,908,119 A * 6/1999 Kump ..... A47F 5/0068 211/113
5,921,190 A 7/1999 Wood
5,921,414 A * 7/1999 Burke ..... A47B 57/42 211/187
D415,365 S * 10/1999 Nicklas ..... D6/684
5,979,677 A * 11/1999 Simpson, II ..... A63H 3/52 211/13.1
6,024,333 A 2/2000 Raasch et al.
6,029,833 A * 2/2000 Yeh ..... A47F 5/0838 108/108
6,053,115 A 4/2000 Felton
6,062,401 A * 5/2000 Hall ..... A47B 57/10 108/144.11
6,082,690 A * 7/2000 Durin ..... H02G 3/263 211/90.01
6,109,461 A 8/2000 Kluge et al.
6,129,224 A 10/2000 Mingers
6,158,599 A * 12/2000 Lazarus ..... A47B 57/42 211/187
6,230,907 B1 * 5/2001 Stuart ..... A47B 55/02 108/108
6,267,064 B1 * 7/2001 Ostertag ..... A47B 13/021 108/108
6,269,906 B1 * 8/2001 Dockter ..... B60R 3/007 182/92
6,302,283 B1 * 10/2001 Yeh ..... A47F 5/116 108/109
6,345,795 B1 2/2002 Bartz, Jr.
D462,541 S 9/2002 Welch
6,460,946 B1 * 10/2002 Beukema ..... A47B 43/00 108/152
6,584,916 B1 7/2003 Felton et al.
6,666,344 B1 * 12/2003 Schneider ..... A47B 47/022 211/175
6,675,725 B2 1/2004 Felton et al.
RE38,517 E * 5/2004 Pfeiffer ..... B65G 1/023 193/35 R
6,918,499 B2 * 7/2005 De Land ..... A47B 96/04 211/103
7,191,908 B2 3/2007 De Rijk
7,240,803 B2 7/2007 Stitchick et al.
7,258,317 B1 * 8/2007 Nagel ..... A47B 96/025 108/108
7,407,060 B2 8/2008 Swartz et al.
7,494,019 B2 * 2/2009 Kessell ..... A47B 57/06 108/108
7,497,344 B2 * 3/2009 Chen ..... A47B 57/40 108/108
7,523,903 B1 * 4/2009 Rindoks ..... A47B 96/028 211/187
7,900,783 B2 * 3/2011 Fernandez ..... A47B 45/00 108/108
8,028,846 B2 * 10/2011 Peota ..... A47B 91/00 108/108
D702,467 S * 4/2014 Huang ..... A47B 47/04 D6/707.19
8,967,576 B2 * 3/2015 Knoll ..... A47F 5/16 211/186
9,119,471 B2 9/2015 Gonzalez et al.
9,277,814 B2 3/2016 Winker
9,339,108 B2 5/2016 Zang et al.
9,770,122 B2 * 9/2017 Gonzalez ..... A47B 96/028
D808,200 S * 1/2018 Davis ..... D6/675.1
9,883,755 B2 2/2018 Gonzalez et al.
2003/0037712 A1 2/2003 Welch et al.
2003/0160012 A1 * 8/2003 Kanouchi ..... A47F 3/063 211/59.2
2003/0233965 A1 * 12/2003 Brazier ..... A47B 96/028 108/108
2003/0234231 A1 * 12/2003 Rowe ..... A47B 57/30 211/90.02
2004/0045919 A1 * 3/2004 Remmers ..... A47B 57/30 211/90.02
2004/0050814 A1 * 3/2004 Roush ..... A47F 5/0018 211/201
2004/0154498 A1 * 8/2004 Borgen ..... A47B 46/005 108/107
2004/0159622 A1 * 8/2004 Craft ..... A47B 87/0246 211/153
2004/0173549 A1 * 9/2004 Herron, III ..... A47B 57/42 211/90.02
2004/0182805 A1 * 9/2004 Harper ..... A47B 96/021 211/90.02
2005/0045787 A1 * 3/2005 Magnusson ..... A47B 96/024 248/235
2005/0092706 A1 * 5/2005 Chang ..... A47B 57/38 211/187
2005/0103733 A1 * 5/2005 Saltzberg ..... A47B 57/50 211/187
2005/0103734 A1 * 5/2005 Saltzberg ..... A47B 57/50 211/187
2005/0127017 A1 * 6/2005 Kessel ..... A47B 57/06 211/187
2005/0145588 A1 * 7/2005 Stitchick ..... A47B 47/022 211/183
2005/0150850 A1 * 7/2005 Stitchick ..... A47B 47/022 211/90.03
2005/0199568 A1 * 9/2005 Gay, II ..... A47F 5/00 211/187
2006/0175495 A1 * 8/2006 Gregory ..... A47B 96/028 248/250
2006/0213849 A1 * 9/2006 Bienick ..... A47B 96/028 211/90.02
2007/0241072 A1 * 10/2007 Bryant ..... A47B 96/021 211/90.02
2007/0295681 A1 * 12/2007 Colin ..... A47F 5/12 211/90.03
2008/0047914 A1 * 2/2008 Young ..... A47B 96/02 211/134
2008/0217496 A1 * 9/2008 Wooten ..... A47B 96/061 248/248
2010/0140202 A1 * 6/2010 Janis ..... A47B 57/34 211/183
2010/0155353 A1 * 6/2010 McAllister ..... A47B 96/028 211/153
2012/0175330 A1 * 7/2012 Nicholls ..... A47B 97/00 211/90.01
2012/0273447 A1 * 11/2012 Stitchick ..... A47B 96/06 211/90.01
2014/0263125 A1 * 9/2014 Gonzalez ..... A47B 96/1408 211/134
2015/0335155 A1 * 11/2015 Winker ..... A47B 87/005 211/90.02
2016/0015174 A1 * 1/2016 Guizzardi ..... A47B 87/0223 211/186

(56) References Cited

U.S. PATENT DOCUMENTS

2017/0310090 A1* 10/2017 Woodley ..... H02B 1/20
2017/0340142 A1* 11/2017 Gonzalez ..... A47B 95/008

OTHER PUBLICATIONS

Sep. 6, 2016 Freestyle Modular Cantilever Shelving System by SPG—9 page specification.

Complaint for Case 3:18-cv-00116 filed Feb. 6, 2018; *SPG International, LLC* vs. *InterMetro Industries Corp*.

"Super Erecta Shelf Post-Type and Direct Wall Mounts" specification sheet; InterMetro Industries Corporation, Apr. 2011.

"HD Super Work Center With Overhead" specification sheet; InterMetro Industries Corporation, Sep. 2000.

"Button-On Cantilever Rack"; https://web.archive.org/web/20061019070526/http://www.jarke.com/pro...; Jarke- division of Leggett & Platt; 2006.

"Cantilever Shelving" brochure; Eagle Group; Mar. 2005.

"Cantilever Shelving System- Heavy Duty Components" specification sheet; Eagle Group, Sep. 2010.

"Chapter 3- Installing FlexWorks Accessories"; Lista International Corporation; May 2000.

"FreedomRail Installation Guide"; OrganizedLiving; 2009.

"Shelving and Shelving Solutions" brochure; Eagle Group; Apr. 2009.

"Storage Racks" Standard Product Catalog; SPG International, LLC; 2010.

"Wire Basket with Brackets 36" x 16""; https://web.archive.org/web/20120507140028/http://www.globalindustria...; Global Equipment Company Inc.; 2012.

Extended European Search Report for EP 18156976.5, conducted May 4, 2018, EPO.

* cited by examiner

CANTILEVER SHELVING SYSTEM

CROSS-REFERENCE TO RELATED APPLICATIONS

This application claims the benefit and priority of IN201721005649, filed Feb. 17, 2017. The entire disclosure of the above application is incorporated herein by reference.

FIELD

The present disclosure relates to cantilever shelving systems and storage rack assemblies.

BACKGROUND

This section provides background information related to the present disclosure which is not necessarily prior art.

Cantilever shelving systems and storage rack assemblies are readily adaptable for supporting and storing a variety of items and have found widespread use in industrial, commercial and residential applications.

Many existing cantilever shelving systems and storage rack assemblies include frames and shelves having fixed dimensions in well-known standard sizes which cannot be adapted or modified to accommodate various and changing customer requirements. Further, known shelving units do not readily accommodate integration with standard-sized industrial and/or commercial equipment with which the shelving system may be associated during use. Consequently, these shelving systems and storage rack assemblies offer limited flexibility in configuration and use.

SUMMARY

This section provides a general summary of the disclosure, and is not a comprehensive disclosure of its full scope or all of its features.

A cantilever shelving system is disclosed and can include a frame structure, a cantilever shelf support structure, and a plurality of load-bearing shelves that can be supported by the cantilever shelf support structure and the frame structure. The shelves can be positioned laterally adjacent to cantilever support arms of the cantilever shelf support structure, and the shelf support surfaces can be coplanar with upper walls of the cantilever support arms. In addition, ends of laterally adjacent shelves do not overlap with a front side of a vertical support member to which the cantilever support arm is mounted.

In one aspect of the disclosure, the cantilever shelving system can include a frame structure comprising a plurality of vertical support members, a lateral support structure interconnecting the vertical support members, and a base. The cantilever shelf support structure can be mounted to the frame structure. A plurality of generally rectangular, load-bearing shelves supported by the cantilever shelf support structure and the frame structure are provided and each of the shelves can include an upper support surface and a plurality of mounting collars located near each corner of the shelf.

In another aspect of the disclosure, the cantilever shelf support structure can include a plurality of horizontally extending cantilever support arms, and at least one cantilever support arm can be mounted to each of the vertical support members and a plurality of shelf support fittings that can be mounted to each of the cantilever support arms.

In still another aspect of the disclosure, the cantilever support arm can include an elongated portion extending from a proximal end to a distal end along a longitudinal axis and having a planar upper wall and opposing side walls. A mounting flange can be located at the proximal end and include opposing side braces spaced laterally apart to enable the mounting flange to closely fit on a vertical support member. At least two slots can be included in each of the side walls, and at least one slot is near the proximal end and at least one slot is near the distal end. The shelf support fitting can include a mounting portion including at least one mounting tab and at least one lock notch, and a support portion having an upward projection laterally offset from the mounting portion. The mounting tab can be inserted into one of the slots and can engage an inside surface of a side wall of the cantilever support arm above the one slot. The lock notch can engage a lower end of the slot. The mounting collars of the load-bearing shelves can engage the upward projections of the shelf support fittings.

In yet another aspect of the disclosure, the base of the frame structure can include a plurality of base supports, with at least two base supports attached, respectively, to at least two vertical support members near a lower vertical end of the vertical support member and form an angle of approximately ninety degrees with the vertical support member. The base supports can include a horizontal support leg extending along a longitudinal axis from a proximal end adjacent to the vertical support member to a distal end, and can have an upper side. A vertical support foot can extend vertically downward from the distal end of the horizontal support leg.

In yet another aspect of the disclosure, a plurality of first base supports can be positioned on the vertical support member at a first vertical height so that the upper sides of the horizontal support legs of the plurality of first base supports lie in a first horizontal plane above a support surface. Further, at least one second base support can be positioned on the vertical support member at a second vertical height so that the upper side of the horizontal support leg of the at least one second base support lies in a second horizontal plane above the support surface. The second horizontal plane can be beneath the first horizontal plane.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
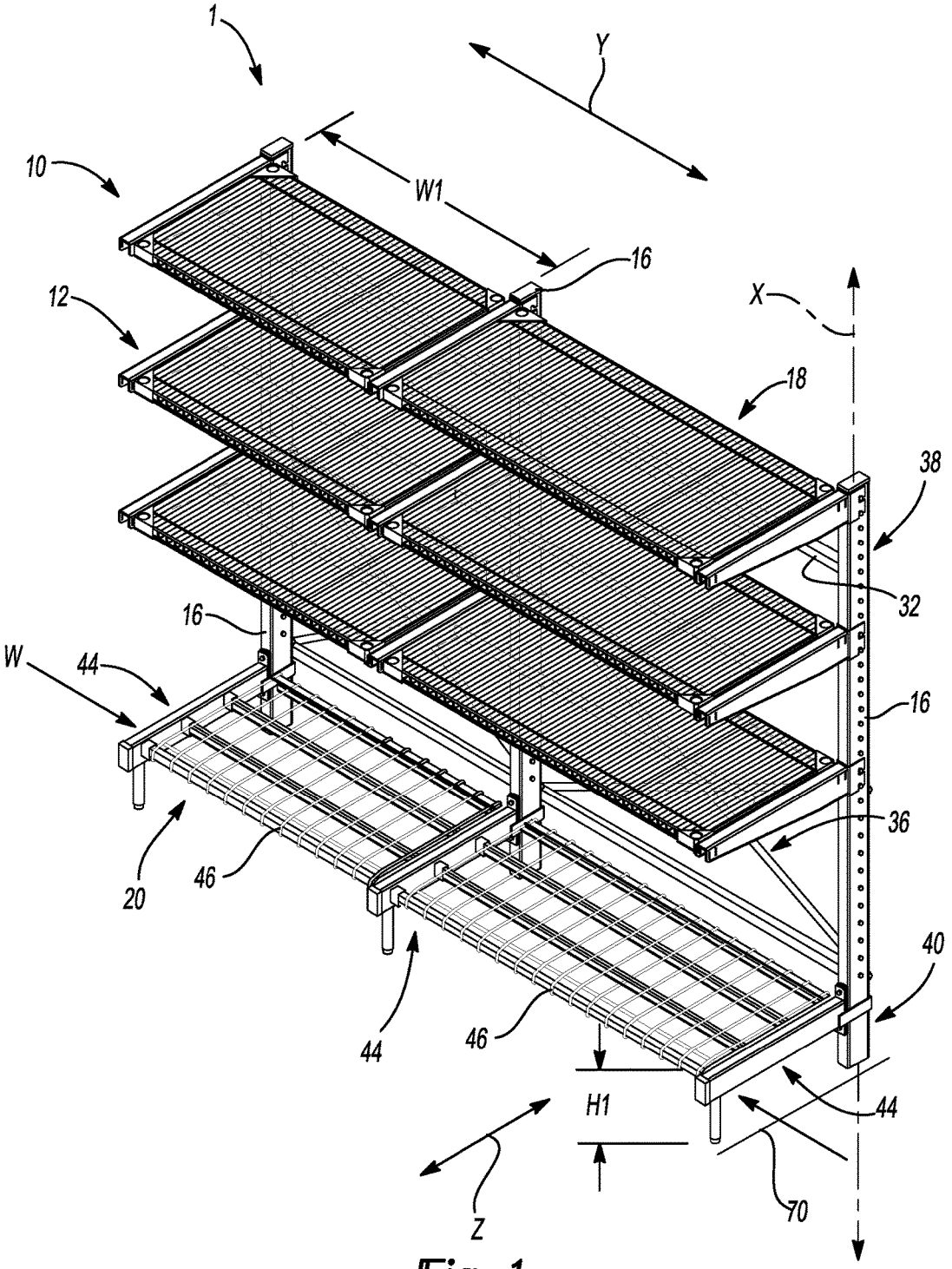
FIG. 1 shows a perspective view of an exemplary cantilever shelving system according to the principles of the present disclosure.

Example embodiments will now be described more fully with reference to the accompanying drawings.

An exemplary cantilever shelving system 1 according to the principles of the present disclosure is shown and understood with reference to FIGS. 1-11. The cantilever shelving system 1 of the present disclosure can provide multiple, vertically-arranged and horizontally-oriented load-bearing platforms for supporting and/or storing items in a workspace or storage area. The cantilever shelving system 1 of the present disclosure can be easily adapted or modified to accommodate various and changing user requirements, and can readily accommodate operable integration with standard-sized industrial and/or commercial equipment with which the shelving system may be associated during use.

With reference to the figures, the cantilever shelving system 1 of the present disclosure can generally include a frame structure 10, a cantilever shelf support structure 12, and a plurality of load-bearing shelves 14 that can be supported by the cantilever shelf support structure 12 and the frame structure 10.

The frame structure 10 can generally include at least two vertically-oriented or upright support members 16, a lateral support structure 18 interconnecting the upright support members 16, and a base 20.

Figure 2:
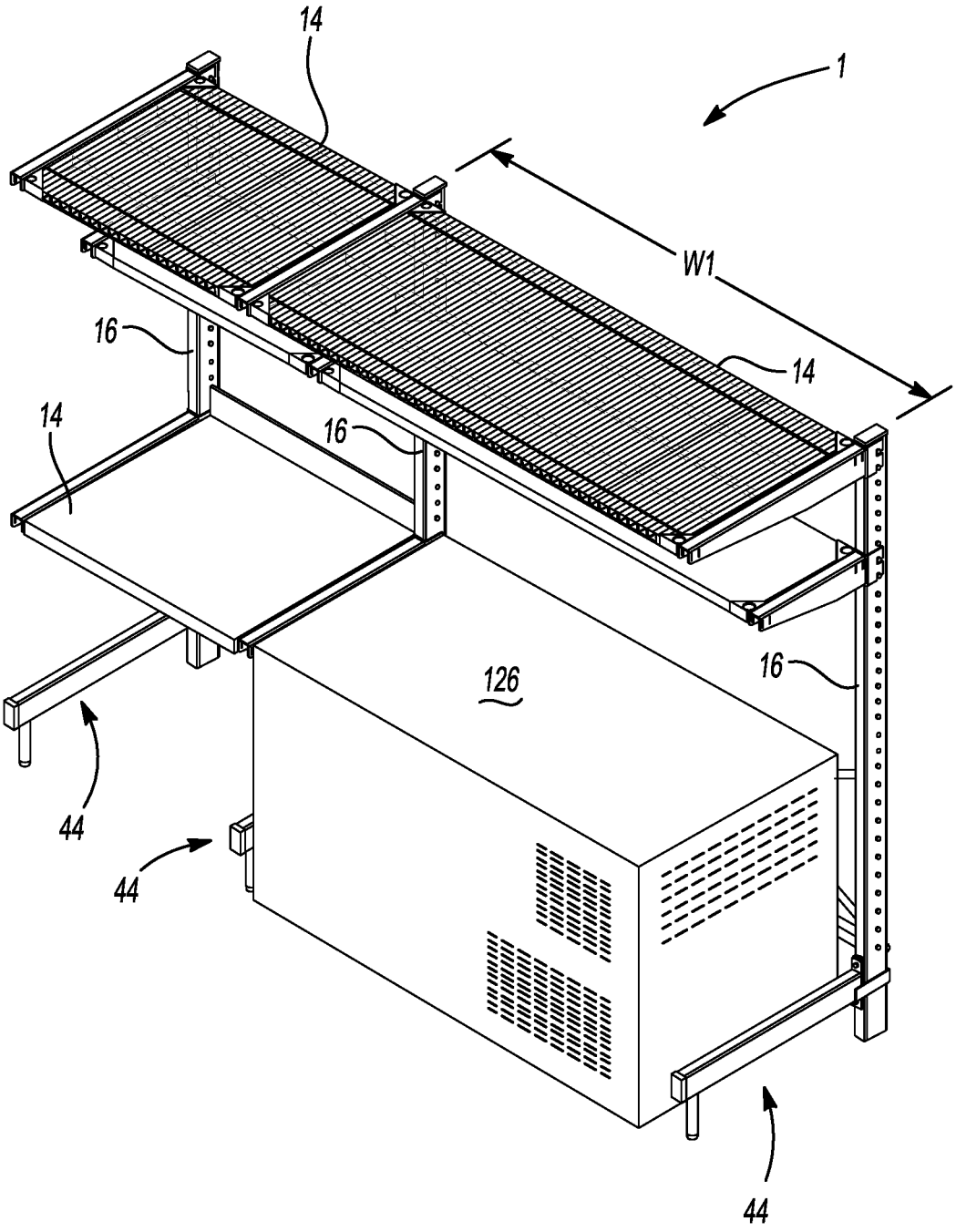
FIG. 2 shows a perspective view of another exemplary cantilever shelving system according to the principles of the present disclosure and including a piece of equipment operably integrated therewith.
Figure 9:
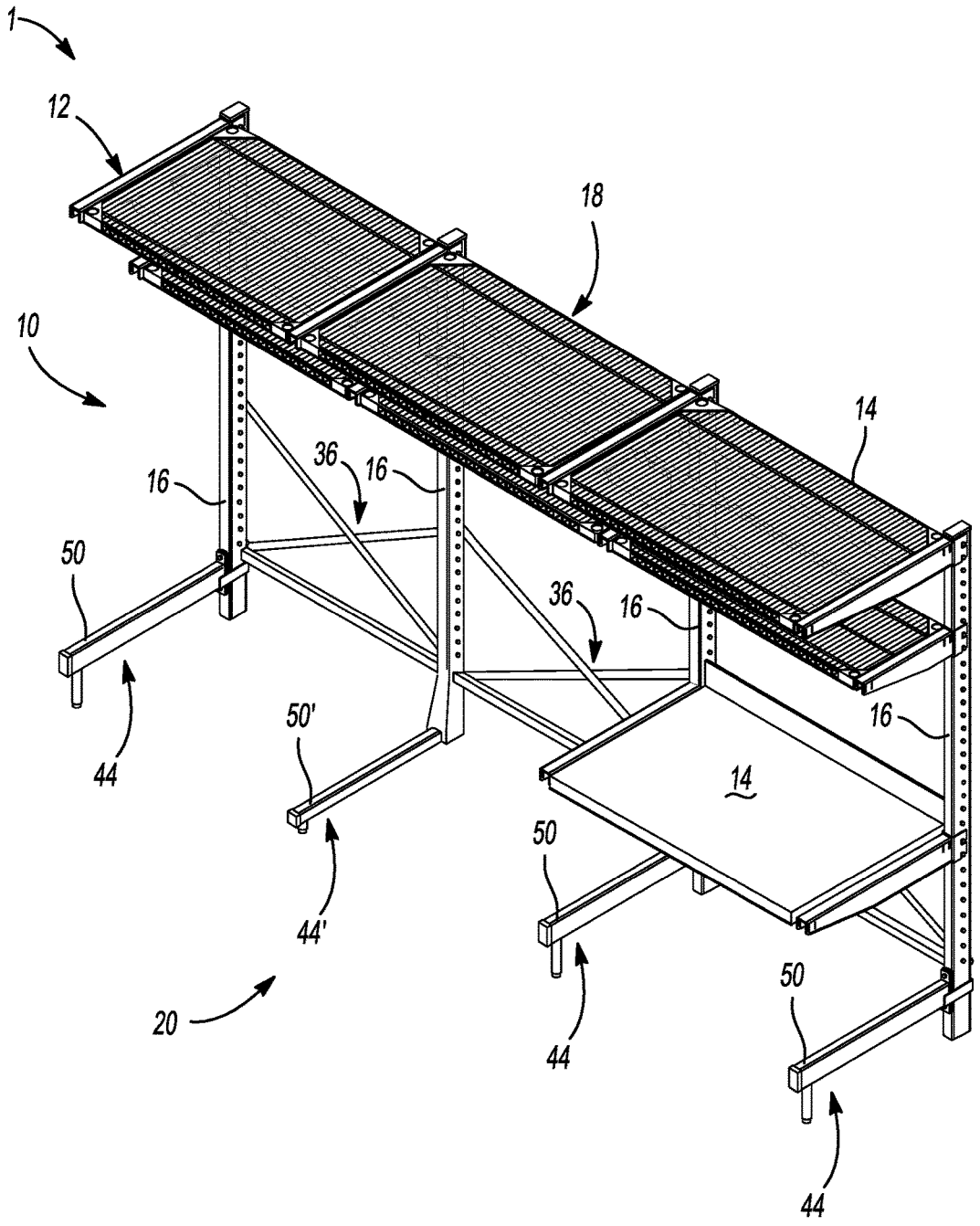
FIG. 9 shows a perspective view of another exemplary cantilever shelving system including a low-profile base support according to the principles of the present disclosure.

Referring to FIGS. 1, 2, and 9, each of the upright support members or vertical support posts 16 can extend vertically along a longitudinal axis X. In one aspect of the present disclosure, the vertical support posts 16 can incorporate a tubular construction or bar extending along the longitudinal axis X and having an exterior surface. In another aspect, a tubular construction can take the form of a hollow, metal tube having a rectangular cross-section having a front side 22, a back side 24, and opposing lateral sides 26. It can be appreciated, however, that other materials and cross-sectional geometries are contemplated within the scope of the present disclosure. Each vertical support post 16 can include an end cap 28 covering each longitudinal end of the vertical support posts 16.

At least two vertical support posts 16 can be positioned from one another in a laterally spaced-apart relationship along a lateral axis Y to establish a width dimension W of the cantilever shelving system 1. As shown in the exemplary embodiment of the cantilever shelving system 1 of the present disclosure of FIG. 1, the cantilever shelving system 1 can include three vertical support posts 16 positioned in a laterally spaced-apart manner and equidistant from one another. However, it can be understood and appreciated, that a cantilever shelving system 1 according to the principles of the present disclosure can be constructed to any desired width dimension W and include any number of vertical support posts 16 (of at least two or more). Further, the vertical support posts 16 can be laterally space-apart equal or unequal distances, depending on the uses or requirements of the cantilever shelving system 1.

Figure 5:
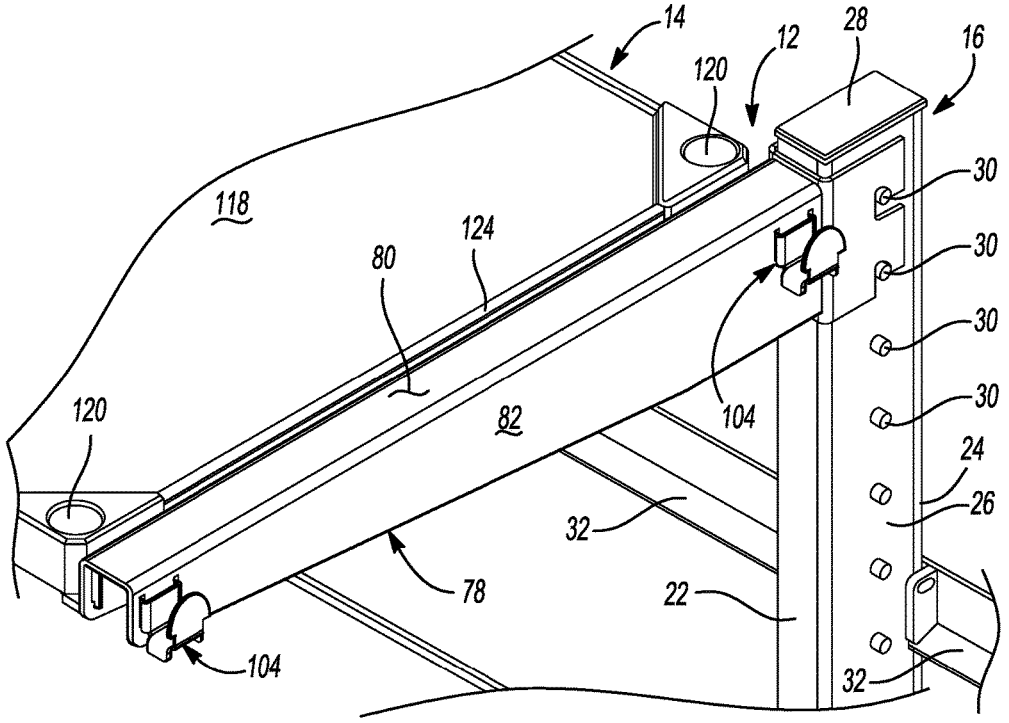
FIG. 5 shows a partial perspective view of the cantilever shelf support structure and load-bearing shelf of the cantilever shelving system of the present disclosure.

As illustrated in FIGS. 1 and 5, each of the vertical support posts 16 can include a plurality of spaced-apart, support members or hanger pins 30 that can protrude or extend outwardly from one or both of the opposing lateral sides 26 of the vertical support posts 16. The hanger pins 30 can be positioned at a plurality of discrete vertical locations in a direction along the longitudinal axis X of the vertical support post 16. The hanger pins 30 can be integrally formed with or fixedly attached to the vertical support posts 16, such as by molding, extruding, forming, mechanical fastening (e.g., threading, interference or deforming), welding, or the like. In one aspect, the hanger pins 30 can exhibit a generally circular, solid cross-section, although cross-sections of other geometries and hollow cross-sections are also contemplated. The hanger pins 30 can protrude from the opposing lateral sides 26 of the vertical support posts 16 so as to be operable to engage the cantilever shelf support structure 12 as will be discussed further herein.

Turning again to FIG. 1, two or more of the vertical support posts 16 can be interconnected to one another by the lateral support structure 18. The lateral support structure 18 can include one or more horizontal crossbars 32. In one aspect of the present disclosure, the horizontal crossbars 32 can have a tubular or bar construction extending along a longitudinal axis and having an exterior surface. In another aspect, a tubular construction can take the form of a hollow, metal tube having a rectangular cross-section having a front side, a back side, and opposing upper and lower sides. It can be appreciated, however, that other materials and cross-sectional geometries are contemplated within the scope of the present disclosure. Each horizontal crossbar 32 can include an end cap (not shown) covering each longitudinal end of the horizontal crossbar 32.

Additionally, or alternatively, the lateral support structure 18 can include one or more cross-braces 36. In one aspect of the present disclosure, the cross-braces 36 can have a stamped, metal construction. However, other materials and configurations are contemplated within the scope of the present disclosure.

The horizontal crossbars 32 can be sized to extend between and/or across some or all of the vertical support posts 16 of the frame structure 10 to laterally interconnect two or more of the vertical support posts 16 together. For example, in one aspect, a horizontal crossbar 32 can be sized to extend between and interconnect two adjacent vertical support posts 16 of the frame structure 10. Alternatively, or in addition, a horizontal crossbar 32 can be sized to extend across and interconnect all of the vertical support posts 16 in the frame structure 10, i.e., across the entire width W of the cantilever shelving system 1. In still another alternative or additional arrangement, a horizontal crossbar 32 can be sized to extend across more than two vertical support posts 16, but less than the entire width W of the shelving system. The horizontal crossbars 32 can be joined or connected to the respective vertical support posts 16 in any of a variety of ways, such as by threaded or deformable fasteners, welding or other similar means.

One or more horizontal crossbars 32 can be positioned at one or more vertical locations along the longitudinal axes X of the vertical support posts 16. In one aspect of the disclosure the cantilever shelving system 1, one or more horizontal crossbars 32 can be included near the upper ends 38 of the vertical support posts 16 and/or a one or more horizontal crossbars 32 can be included near the lower ends 40 of the vertical support posts 16, as shown in FIGS. 1 and 3, for example.

Also as shown in the embodiments of FIGS. 1 and 9, in addition to the one or more horizontal crossbars 32, the lateral support structure of the cantilever shelving system 1 can include one or more cross-braces 36. The cross-braces 36 can include a pair of flat, stamped metal slats or bars 42 arranged in a criss-crossed relationship and fastened or joined to one another at approximately their respective midpoints, such as in a "X" pattern.

The cantilever shelving system 1 can include cross-braces 36 between each of the adjacent pairs of vertical support posts 16, as shown in the figures. As with the horizontal cross bars 32, the cross-braces 36 can be sized to extend between and interconnect two adjacent vertical support posts 16, or some or all of the vertical support posts 16 included in the cantilever shelving system 1. The cross-braces 36 can be joined or connected to the respective vertical support posts 16 in any of a variety of ways, such as by threaded or deformable fasteners, welding or other similar means.

Figure 3:
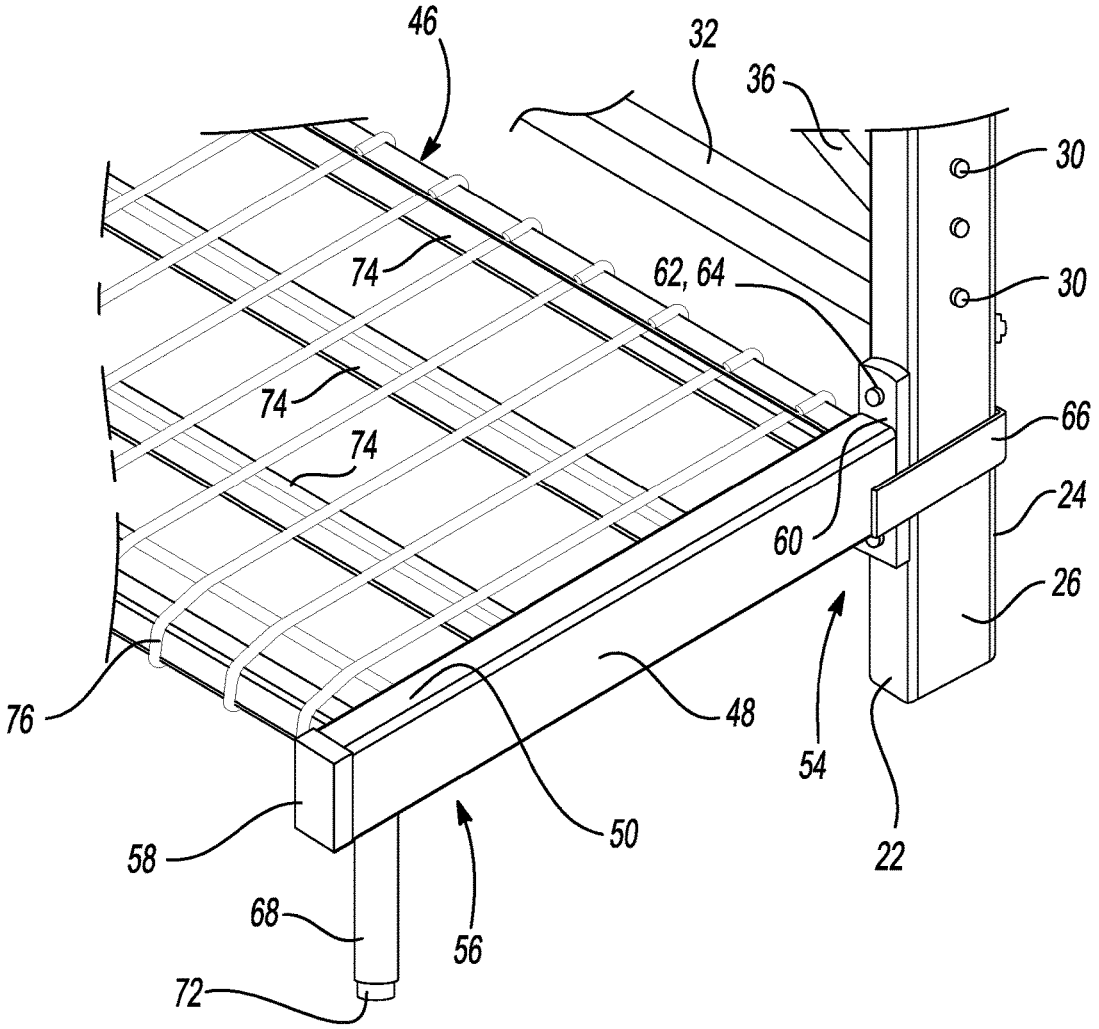
FIG. 3 is an enlarged detail view showing a portion of the base of cantilever shelving system of FIG. 1.
Figure 4:
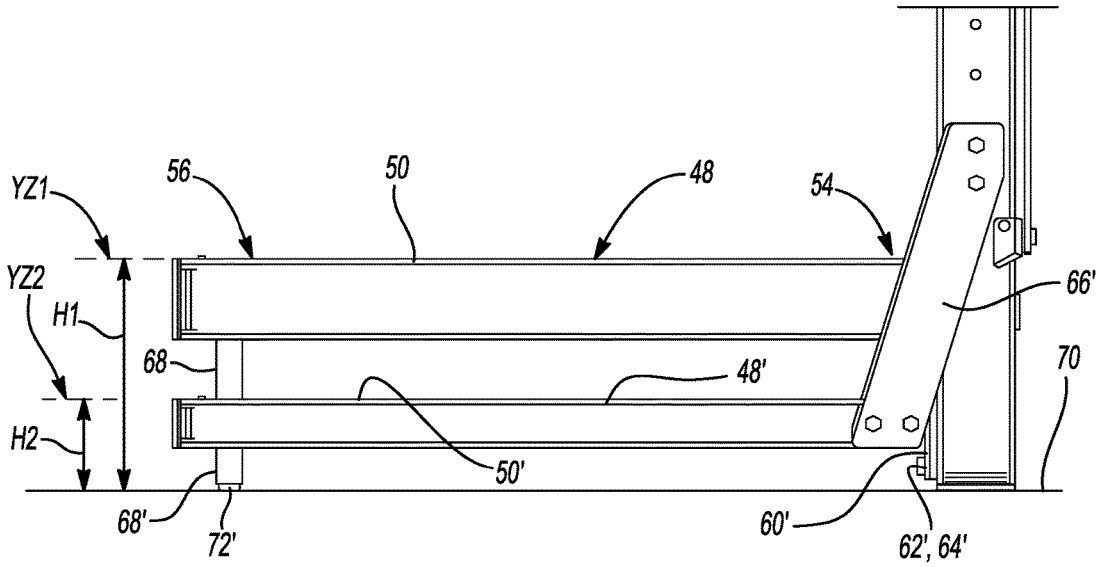
FIG. 4 is a partial side view showing base supports for the cantilever shelving system according to the principles of the present disclosure.

Referring to FIGS. 1, 3 and 4, the frame structure can also include a base 20. The base 20 can include a plurality base supports 44 and one or more base shelves 46.

Each base support 44 can be associated with and can be attached to a corresponding a vertical support post 16. Therefore, the base 20 of the frame structure 10 can include at least two base supports 44 that can each be associated with the vertical support posts 16 located at opposite lateral ends of the cantilever shelving system 1. Every vertical support post 16, however, may not have a corresponding base support 44 attached thereto. For example, if three vertical support posts 16 are included in the frame structure 10, there may not be a base support 44 attached the vertical support post 16 intermediate the opposite lateral ends of the cantilever shelving system 1.

The base support 44 can include a horizontal support leg 48 which can have a tubular or bar construction having an exterior surface. In another aspect, the tubular construction can take the form of a hollow, metal tube having a rectangular cross-section having an upper side 50, a lower side 52, and opposing lateral sides 54. It can be appreciated, however, that other materials and cross-sectional geometries are contemplated within the scope of the present disclosure. In one aspect of the present disclosure, the horizontal support legs 48 of the base supports 44 can all have the same cross-sectional dimensions. In another aspect of the disclosure, a horizontal support leg 48 of at least one base support 44 can have cross-sectional dimension(s) resulting in a different cross-section than the other horizontal support legs 48 of other base supports 44.

The horizontal support leg 48 can extend along a longitudinal axis Z from a proximal end 54 that is adjacent to the corresponding vertical support post 16 to which it attached, toward a distal or terminal end 56. The horizontal support leg 48 can extend forward from the front side 22 of the corresponding vertical support post 16 such that the horizontal support leg 48 can form an angle of approximately ninety degrees with the vertical support post 16. The terminal end 56 of each horizontal support leg 48 can include an end cap 58.

The horizontal support leg 48 can be attached or connected to a respective vertical support post 16 at its proximal end 54, such as by threaded or deformable fasteners, welding or other means. For example, a flange 60 can be integral with or affixed to (e.g., such as by welding) the proximal end 54 of the horizontal support leg 48. The flange 60 can extend along the front side 22 of the vertical support post 16 above and below the horizontal support leg 48. The flange 60 can include mounting apertures 62. The mounting apertures 62 can accommodate fasteners 64 which can engage the vertical support post 16 to fixedly attach the horizontal support leg 48 to the vertical support post 16. In addition, or alternatively, a mounting strap 66 can be fixedly attached to the lateral sides 54 of the horizontal support leg 48 at the proximal end 54 of the horizontal support leg 48 and extend to the lateral side(s) 26 of the vertical support post 16 to also secure the horizontal support leg 48 to the vertical support post 16.

As shown in FIG. 3, the base support 44 can also include a support foot 68 located at or near the distal end 56 of the horizontal support leg 48. The support foot 68 can extend generally vertically downwardly from the horizontal support leg 48. The support foot 68 can be adjustable in length. For example, the support foot 68 can include a leveler, such as a bolt leveler 72.

The base support 44 can be attached to the vertical support post 16 at or near a lower vertical end of the vertical support post 16. Thus, the base support 44 and the lower end of the vertical support post 16 can cooperate to provide a stable foundation for the cantilever shelving system 1 on the support surface 70 (e.g., a floor) upon which the cantilever shelving system 1 is positioned for use. In one aspect of the disclosure, all of the base supports 44 can be positioned and attached to the vertical support posts 16 at the same vertical height H1, such as shown in FIG. 1. In this configuration, the upper sides 50 of all the horizontal support legs 48 can all be situated in a common i.e., first, horizontal plane YZ1. For example, the base supports 44 can be positioned on the vertical support post 16 such that the upper sides 50 of the horizontal support legs 48 are about 6 to 10 inches above the support surface 70.

Figure 11:
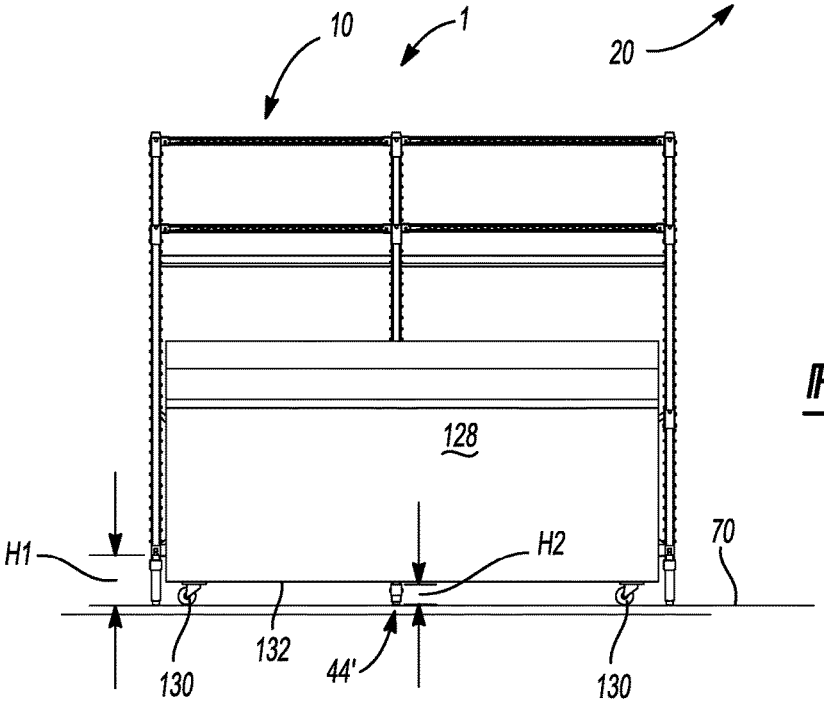
FIG. 11 shows a front view of a cantilever shelving system according to the principles of the present disclosure and including a piece of equipment operably integrated therewith.

In another aspect of the disclosure, as illustrated in FIGS. 4, 9 and 11, at least one base support 44' can be positioned on the vertical support post 16 at a vertical height H2 different than other base supports 44. In such a configuration, the upper side 50' of the horizontal support leg 48' of the one base support 44' lies in a different, i.e., second, horizontal plane YZ2. For example, the second horizontal plane H2 can be vertically lower than the first horizontal plane H1. With reference to FIGS. 4 and 9, an exemplary low-profile base support 44' is shown. The low-profile base support 44' can be positioned on the vertical support post 16 such that the upper side 50' of its horizontal support leg 48' is about 3 to 5 inches above the support surface 70.

Figure 12:
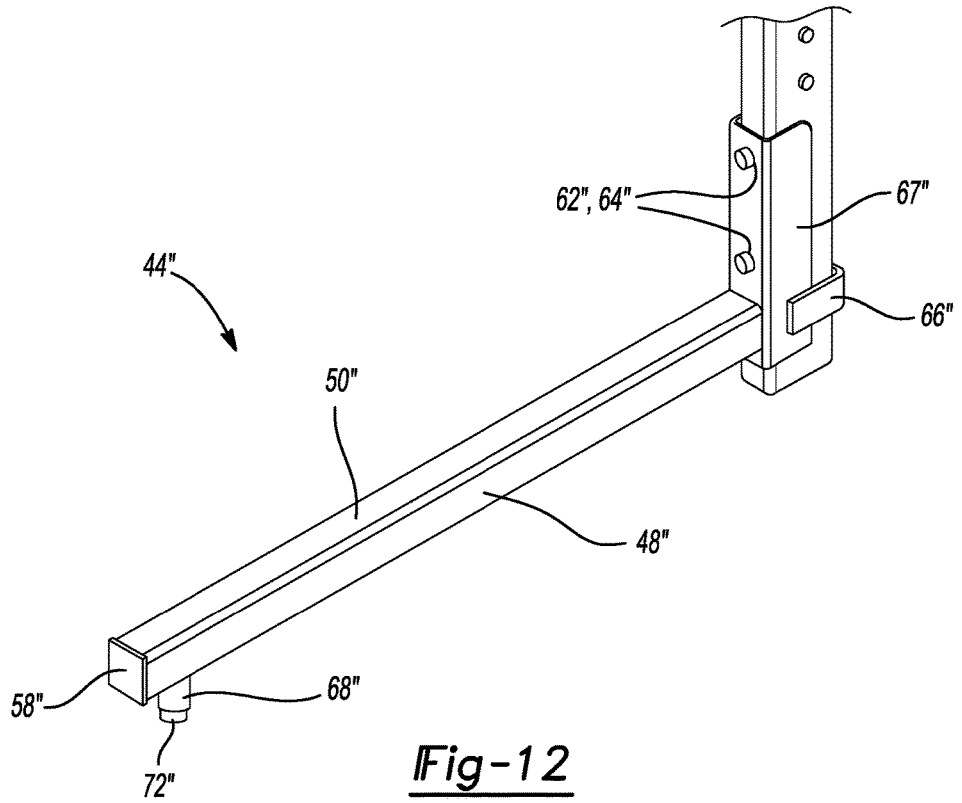
FIG. 12 shows a partial perspective view of an alternative base support for the cantilever shelving system according to the principles of the present disclosure.
Figure 13:
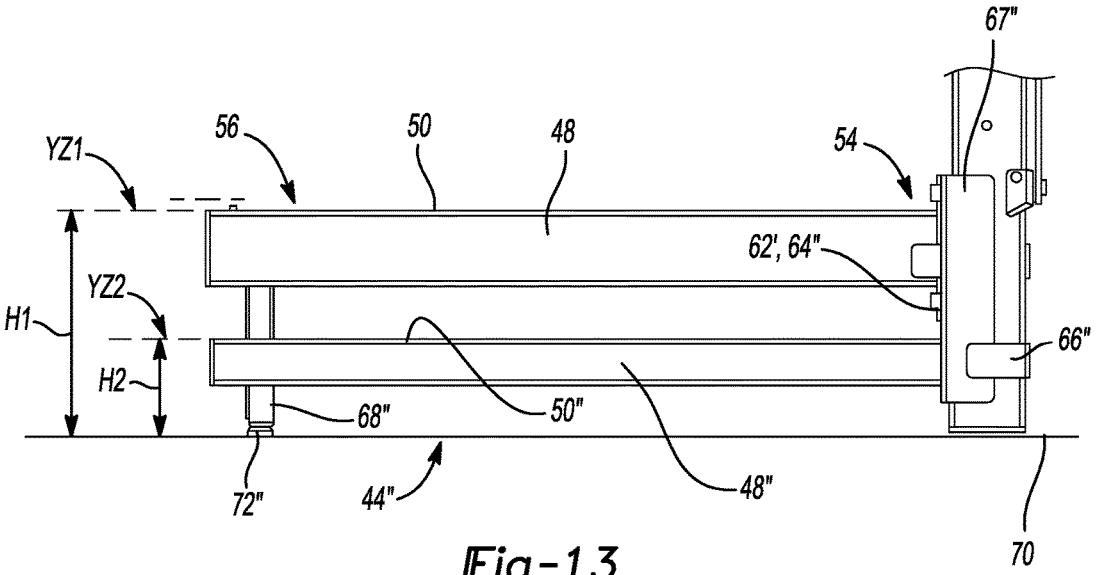
FIG. 13 shows a partial side view of the alternative base support of FIG. 12.

With reference to FIGS. 12 and 13, an alternative embodiment of a base support 44" is shown. As illustrated in FIGS. 12 and 13, the base support 44" includes both a mounting strap 66" and a mounting bracket 67" which can be securely connected to the vertical support post 16 by fasteners 64" passing mounting through apertures 62" in the mounting bracket 67".

One or more base shelves 46 can also be included in the base 20. A base shelf 46 can be positioned on or between adjacent base supports 44. Alternatively, a base shelf 46 can span more than two base supports 44. The base shelf 46 can be fixedly attached to two or more of the base supports 44. In addition to providing a lower storage space for the cantilever shelving system 1, the one or more base shelves 46 can add to the rigidity of the base 20 and the frame structure 10 when securely fastened to the base supports 44.

The base shelf 46 can include a construction of cross members 74 fixedly connected to one another, such as in a rectangular framework. A support surface 76 can be attached to an upper side of the framework. In one aspect, the support surface 76 can include a wire rack. In other aspects, the support surface can include a panel.

Figure 6:
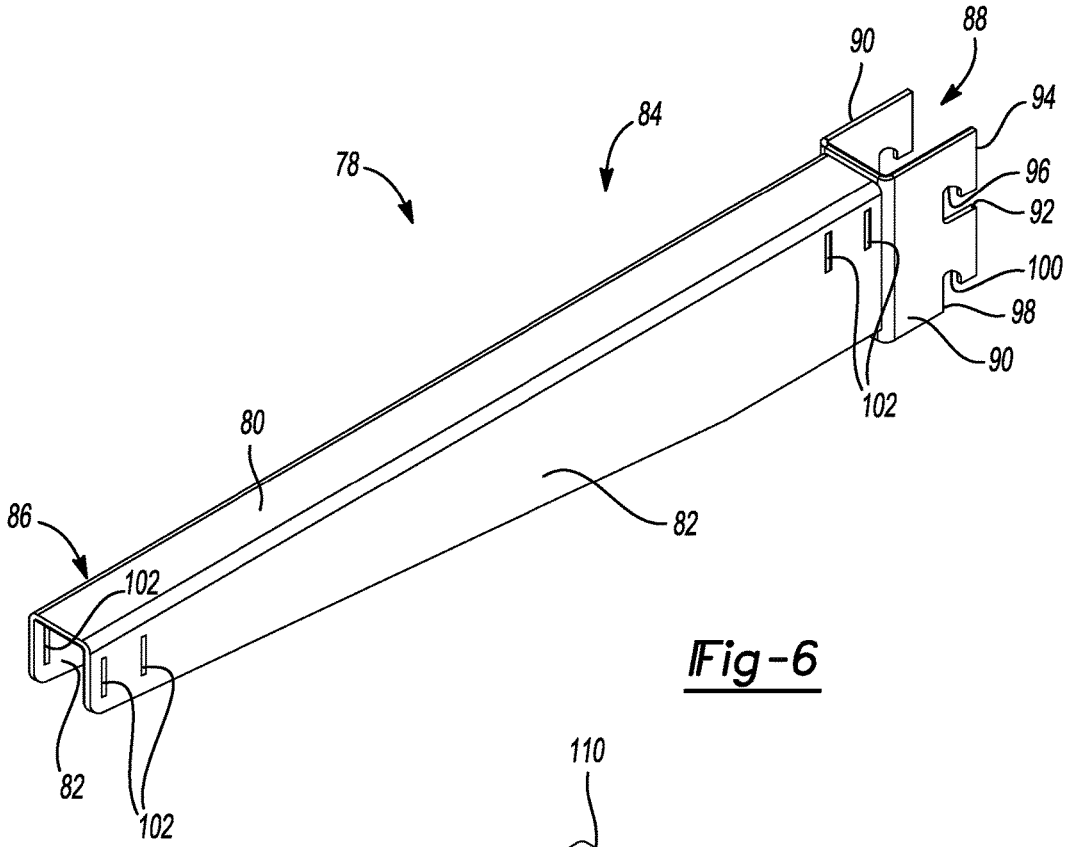
FIG. 6 is a perspective view of an exemplary horizontal cantilever support arm for the cantilever shelving system according to the principles of the present disclosure.
Figure 7:
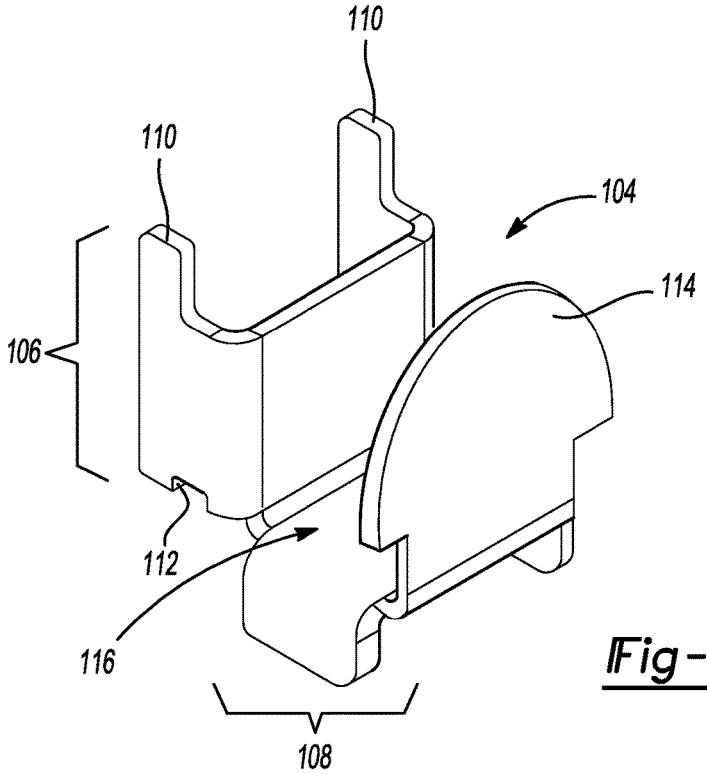
FIG. 7 is a perspective view of a shelf support fitting for the cantilever shelving system according to the principles of the present disclosure.

Referring to FIGS. 5-8, the cantilever shelf support structure 12 of the cantilever shelving system 1 of the present disclosure can be understood. The cantilever shelf support structure 12 can include a plurality of horizontally extending cantilever support arms 78. As best shown in FIG. 6, an exemplary cantilever support arm 78 can comprise an elongated downwardly open channel having a planar upper wall 80 and opposing planar side walls 82. The cantilever support arms 78 can extend from a proximal end 84 to a distal end 86 along a longitudinal axis Z2. The side walls 82 of the cantilever support arms 78 can be tapered, narrowing from the proximal end 84 to the distal end 86.

A mounting flange 88 can be integrally formed with or attached to the proximal end 84 of the cantilever support arm 78. The mounting flange 88 can include opposing side braces 90 that are spaced laterally apart to enable the mounting flange 88 to closely fit on, over or around the opposing lateral sides 26 of a vertical support post 16. Each of the side braces 90 can include at least a first open slot 92 extending to a rear end 94 of the mounting flange 88. The first open slot 92 can terminate in an offset portion 96. Additionally, each of the side braces 90 can also include a second open slot 98 having a terminal end 100. The second open slot 98 can be offset from the first open slot 92. In one aspect, the second open slot 98 is vertically aligned with and positioned below the offset portion 96 of the first open slot 92. The first and second open slots 92, 98 can be sized to accommodate and engage with the hanger pins 30 on the vertical support posts 16.

At least two elongated apertures or narrow slots 102 can be included in each of the side walls 82 of the cantilever support arm 78. At least one narrow slot 102 can be included near the proximal end 84 of the cantilever support arm 78, and at least one narrow slot 102 near the distal end 86 of the cantilever support arm 78. In one aspect, a pair of vertically extending and generally parallel narrow slots 102 can be included near each of the proximal and distal ends 84, 86 of each of the side walls 82 of the cantilever support arm 78, as shown in FIG. 6.

The cantilever shelf support structure 12 can also include a plurality of shelf support fittings 104. The shelf support fittings 104 can be adapted to attach to the cantilever support arms 78 by way of the narrow slots 102 in the side walls 82 of the cantilever support arms 78 as best seen in FIG. 5. Each shelf support fitting 104 can include a mounting portion 106 and a support portion 108. The mounting portion 106 can include at least one mounting tab 110 at an upper end and at least one lock notch 112 at a lower end. The mounting tab 110 can engage an inside surface of the side wall 82 of the cantilever support arm 78 above the narrow slot 102 and the lock notch 112 can engage a lower end of the narrow slot 102 when the shelf support fitting 104 is attached to the cantilever support arm 78.

The support portion 108 of the shelf support fitting 104 can be positioned adjacent to and offset from a lower end of the mounting portion 106. The support portion 104 can include an upward projection 114 at an outer end of the support portion 108 that is offset from the mounting portion 106 by a horizontal base 116. The projection 114 can be adapted to engage a load-bearing shelf 14.

FIGS. 1, 2, 5 and 8 show exemplary load bearing shelves 14 for use in the cantilever shelving system 1 of the present disclosure. The shelves 14 can be generally rectangular in shape and provide a load-bearing upper support structure or surface 118. The shelves 14 can include, for example, wire shelves and panel shelves well-known in the art having standard length dimensions, e.g., 24, 30, 36, 42, 48, 60 and 72 inches. Each shelf 14 can include a shelf mounting collar 120 at or near each of the four corners of the shelf 14. The shelf mounting collar 120 can be a generally hollow cylinder having an open lower end and a closed upper end. The shelf mounting collar 120 can engage the projection 114 and base 116 of the support portion 108 of the shelf support fitting 104 to attach the shelf 14 to the cantilever support arm 78. Suitable load-bearing shelves 14 that can be used in the cantilever shelving system 1 of the present disclosure are available from InterMetro Industries Corporation, the assignee of the present application, under the Super Erecta Shelf® product line.

Figure 8:
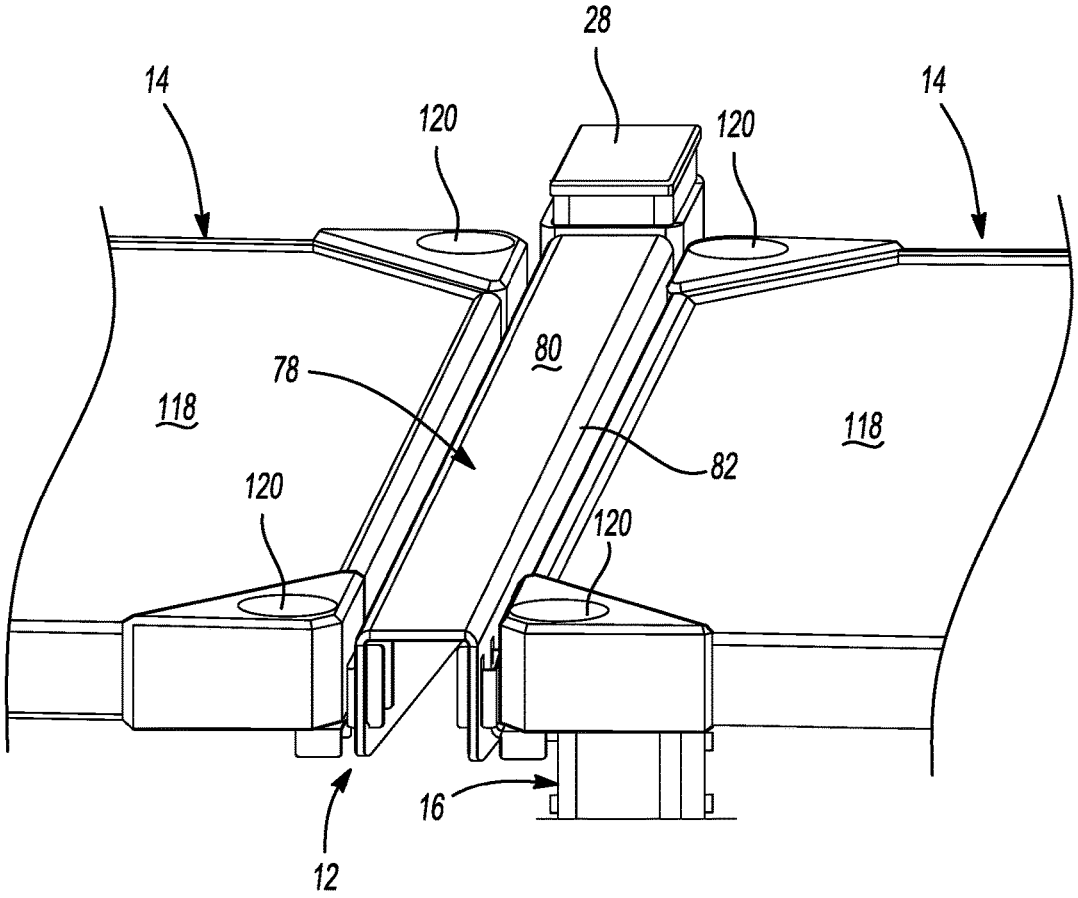
FIG. 8 shows a partial perspective view of a portion of two adjacent load-bearing shelves of the cantilever shelving system of the present disclosure.

The cantilever support arms 78 can be attached to the vertical support posts 16, as best illustrated in FIGS. 5 and 8. The mounting flange 88 of the cantilever support arm 78 can slide over lateral sides 26 of the vertical support post 16. The mounting flange 88 can slide horizontally past the hanger pins 30 which can then engage the first and second open slots 92, 98 in the braces 90 of the mounting flange 88. When the proximal end 84 of the cantilever support arm 78 abuts the front side 22 of the vertical support post 16, the cantilever support arm 78 and mounting flange 88 can slide vertically downwardly so that the hanger pins 30 can simultaneously engage or abut against the offset portion 96 of the first open slot 92 and the terminal end 100 of the second open slot 98. Thus, the cantilever support arm 78 is attached to the vertical support post 16 in a cantilevered manner.

A load-bearing shelf 14 as previously described can then be installed between two adjacent cantilever support arms 78. The shelf 14 can be lowered between the cantilever support arms 78 so that the shelf mounting collars 120 engage corresponding shelf support fittings 104 attached to the cantilever support arms 78. Thus, as illustrated in FIGS. 5 and 8, in the cantilever shelving system 1 of the present disclosure, the shelf 14 can be located adjacent to the cantilever support arm 78 and the end 124 of the shelf 14 does not overlap with the front side 22 of the vertical support post 16. As best shown in FIG. 8, the upper support surfaces 118 of the adjacent load-bearing shelves 14 can be coplanar. Moreover, the upper wall 80 of the cantilever support arm 78 is also coplanar with the support surfaces 118 of the adjacent shelves 14. Therefore, the cantilever support arm 78 of the cantilever shelving system 1 of the present disclosure can provide a continuous and smooth transition surface between adjacent shelves 14.

Referring again to FIGS. 1, 2 and 8, the cantilever shelving system 1 of the present disclosure, and particularly arrangement of the cantilever shelf supporting structure 12, can enable the width dimension W1 between adjacent portions of the frame structure 10, including the vertical support posts 16 and base supports 44, to be at least the same value as the length dimension of the shelf 14. For example, when a 36 inch shelf is installed in the cantilever shelving system 1 of the present disclosure, the width dimension W1 between the adjacent portions of the frame structure 10 can be at least 36 inches. This feature is unlike prior known cantilever shelving systems. In prior known cantilever shelving systems, the width dimension between adjacent portions of the frame supporting a shelf is less than the length dimension of the shelf. This is because prior known supporting structure for mounting the shelf to the frame is located directly beneath the shelf or that structure forms part of the shelf, itself.

It can be appreciated that the cantilever shelving system 1 of the present disclosure provides significant advantages for adapting and/or modifying the cantilever shelving system 1 to accommodate various user requirements over known shelf systems. In addition, the cantilever shelving system 1 of the present disclosure can easily be operably integrated with standard industrial and/or commercial machinery or equipment with which the cantilever shelving system 1 may be associated during use.

Figure 10:
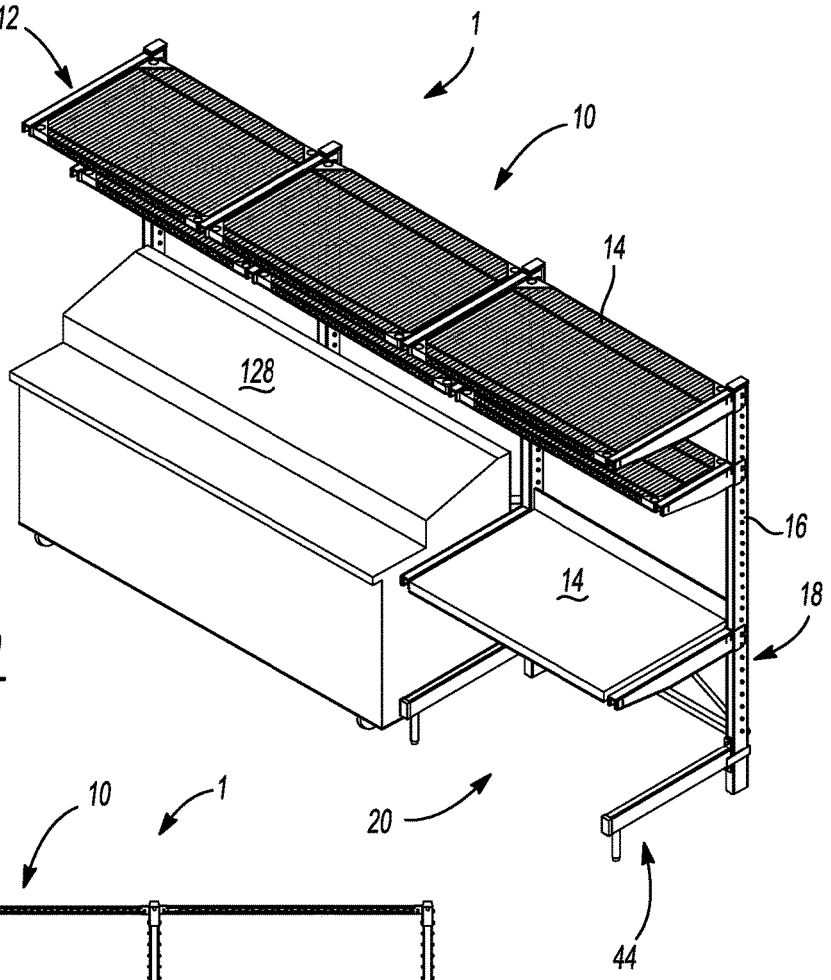
FIG. 10 shows a perspective view of the cantilever shelving system of FIG. 9 and including a piece of equipment operably integrated therewith.

For example, common commercial kitchen equipment 126 can have standard dimensions corresponding to the dimensions of known standard-sized shelves. In FIG. 2, a standard piece of kitchen equipment 126 is shown having a standard width dimension. The equipment 126 can be operably integrated with the cantilever shelving system 1 and located in the space created in the frame structure 10, between two of the vertical support posts 16 and corresponding base supports 44 and beneath the standard length shelves 14. As another example, a standard-wide piece of kitchen equipment 128 can be operably integrated with a cantilever shelving system 1 including a low-profile base support 44', as shown in FIGS. 9-11. The wide equipment 128 can, for example be moveable on casters 130 which can raise the base 132 of the equipment 128 about four to six inches above the floor 70. The base 132 of the wide equipment 128 can pass over the low-profile base support 44' and can be located in the space created in the frame structure 10 between the vertical support posts 16 and corresponding base supports 44 and beneath the standard length shelves 14.

Additionally, it can also be appreciated from FIGS. 1, 2, and 9, that the cantilever shelving system 1 can incorporate a plurality of shelves 14, and the shelves 14 can have a plurality of different length and width dimensions. Further, it can be appreciated that the cantilever shelving system 1 can be constructed and/or modified (e.g., widened or narrowed) simply and easily by adding or removing portions of the frame structure 10 (e.g., vertical support posts 16 and base supports 44, 44').

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A cantilever shelving system comprising:

a frame structure comprising a plurality of vertical support members, a lateral support structure interconnecting the vertical support members, and a base;

a cantilever shelf support structure mounted to the frame structure; and a plurality of generally rectangular, load-bearing shelves supported by the cantilever shelf support structure and the frame structure, wherein each of the shelves comprises an upper support surface and a plurality of mounting collars, wherein a mounting collar of said plurality of mounting collars is located near each corner of each shelf;

wherein the cantilever shelf support structure comprises:

a plurality of horizontally extending cantilever support arms, wherein a corresponding cantilever support arm of said plurality of cantilever support arms is mounted to each of the vertical support members; and a plurality of shelf support fittings, at least two shelf support fittings mounted to each of the cantilever support arms;

wherein each cantilever support arm comprises:

an elongated portion extending from a proximal end to a distal end along a longitudinal axis and having a planar upper wall and opposing side walls; and a mounting flange located at the proximal end and including opposing side braces spaced laterally apart to enable the mounting flange to receive and be mounted on a corresponding vertical support member of said plurality of vertical support members; and at least two slots included in each of the side walls, wherein at least one slot of said at least two slots is near the proximal end and at least one slot of said at least two slots is near the distal end;

wherein each shelf support fitting comprises:

a mounting portion comprising at least one mounting tab and at least one lock notch; and a support portion comprising an upward projection laterally offset from the mounting portion;

wherein the at least one mounting tab is inserted into one of the at least two slots and engages an inside surface of a corresponding side wall of said opposing side walls of a corresponding cantilever support arm of said plurality of cantilever support arms above the one slot and the lock notch engages a lower end of the one slot; and wherein the upward projections of the shelf support fittings are inserted into corresponding mounting collars of said plurality of mounting collars of the load-bearing shelves;

wherein the shelves are positioned laterally adjacent to the cantilever support arms and the upper support surfaces of the load-bearing shelves are coplanar with the upper walls of the cantilever support arms.

2. The cantilever shelving system of claim 1, wherein each of the side braces includes a first open slot extending to a rear end of the mounting flange, the first open slot terminating in an offset portion.

3. The cantilever shelving system of claim 2, wherein each of the side braces further includes a second open slot having a terminal end; and wherein the second open slot is below the first open slot.

4. The cantilever shelving system of claim 3, wherein each of the vertical support members comprise a plurality of vertically spaced-apart hanger pins that extend outwardly from one or both of opposing lateral sides of the vertical support member; and wherein the first and second open slots are sized to accommodate and engage the hanger pins.

5. The cantilever shelving system of claim 1, wherein the base comprises a plurality of base supports, each base support being attached near a lower vertical end of a corresponding vertical support member of said plurality of vertical support members;

wherein each base support comprises:

a horizontal support leg extending along a longitudinal axis from a proximal end adjacent to the corresponding vertical support member to a distal end and comprising an upper side, wherein the horizontal support leg forms an angle of approximately ninety degrees with the corresponding vertical support member; and a vertical support foot extending vertically downward from the distal end of the horizontal support leg;

wherein the plurality of base supports comprises a plurality of first base supports and at least one second base support; wherein the plurality of first base supports are mounted on at least two vertical support members of said plurality of vertical support members at a first vertical height so that the upper sides of the horizontal support legs of the plurality of first base supports lie in a first horizontal plane above a ground surface; and wherein the at least one second base support is mounted on at least one of the plurality of vertical support members at a second vertical height so that the upper side of the horizontal support leg of the at least one second base support lies in a second horizontal plane above the ground surface; and wherein the second horizontal plane is beneath the first horizontal plane.

6. The cantilever shelving system of claim 5, wherein the plurality of first base supports are attached to the corresponding at least two vertical support members at a vertical height about 6 to 10 inches above the ground surface; and wherein the at least one second base support is attached to at least one of the plurality of vertical support members at a vertical height about 3 to 5 inches above the ground surface.

7. The cantilever shelving system of claim 1, wherein the lateral support structure comprises one or more horizontal crossbars and one or more cross-braces, wherein the one or more crossbars extend between and/or across some or all of the vertical support members to laterally interconnect two or more of the vertical support members of said plurality of vertical support members;

wherein the one or more horizontal crossbars are positioned at one or more vertical locations along longitudinal axes of the vertical support members;

wherein at least one crossbar of said one or more crossbars is located near an upper end of the vertical support members and at least one crossbar of said one or more crossbars is located at lower end of the vertical support members;

wherein the one or more cross-braces each include a pair of slats arranged in a crossed relationship and fastened to one another in an "X" pattern; and wherein the one or more cross-braces are between adjacent pairs of the vertical support members.

8. A cantilever shelving system comprising:

a frame structure comprising a plurality of vertical support members, a lateral support structure interconnecting the vertical support members, and a base;

a cantilever shelf support structure mounted to the frame structure; and a plurality of generally rectangular, load-bearing shelves supported by the cantilever shelf support structure and the frame structure;

wherein the base comprises a plurality of base supports, wherein each base support is attached near a lower vertical end of a corresponding vertical support member of said plurality of vertical support members;

wherein each base support comprises:

a horizontal support leg extending along a longitudinal axis from a proximal end adjacent to the corresponding vertical support member to a distal end and comprising an upper side, wherein the horizontal support leg forms an angle of approximately ninety degrees with the corresponding vertical support member; and a vertical support foot extending vertically downward from the distal end of the horizontal support leg;

wherein the plurality of base supports comprises a plurality of first base supports and at least one second base support; wherein the plurality of first base supports are mounted on at least two vertical support members of said plurality of vertical support members at a first vertical height so that the upper sides of the horizontal support legs of the plurality of first base supports lie in a first horizontal plane above a ground surface; and wherein the at least one second base support is mounted on at least one of the plurality of vertical support members at a second vertical height so that the upper side of the horizontal support leg of the at least one second base support lies in a second horizontal plane above the ground surface; and wherein the second horizontal plane is beneath the first horizontal plane; and wherein two of the plurality of first base supports are separated by a first width defining a space therebetween; wherein the space is configured to accommodate a piece of commercial equipment having a second width greater than at least half of the first width such that the piece of commercial equipment is received in the space with one of the at least one second base support being located beneath the piece of commercial equipment.

9. The cantilever shelving system of claim 8, wherein the plurality of first base supports are attached to the corresponding at least two vertical support members at a vertical height about 6 to 10 inches above the ground surface; and wherein the at least one second base support is attached to at least one of the vertical support members at a vertical height about 3 to 5 inches above the ground surface.

10. The cantilever shelving system of claim 8, wherein each of the shelves comprises an upper support surface and a plurality of mounting collars, wherein a mounting collar of said plurality of mounting collars is located near each corner of each shelf; and wherein the cantilever shelf support structure comprises:

a plurality of horizontally extending cantilever support arms, wherein a corresponding cantilever support arm of said plurality of cantilever support arms is mounted to each of the vertical support members; and a plurality of shelf support fittings, at least two shelf support fittings mounted to each of the cantilever support arms;

wherein each cantilever support arm comprises:

an elongated portion extending from a proximal end to a distal end along a longitudinal axis and having a planar upper wall and opposing side walls; and a mounting flange located at the proximal end and including opposing side braces spaced laterally apart to enable the mounting flange to receive and be mounted on a corresponding vertical support member of said plurality of vertical support members; and at least two slots included in each of the side walls, wherein at least one slot of said at least two slots is near the proximal end and at least one slot of said at least two slots is near the distal end;

wherein each shelf support fitting comprises:

a mounting portion comprising at least one mounting tab and at least one lock notch; and a support portion comprising an upward projection laterally offset from the mounting portion;

wherein the at least one mounting tab is inserted into one of the at least two slots and engages an inside surface of a corresponding side wall of said opposing side walls of each cantilever support arm above the one slot and the lock notch engages a lower end of the one slot; and wherein the upward projections of the shelf support fittings are inserted into corresponding mounting collars of said plurality of mounting collars of the load-bearing shelves;

wherein the shelves are positioned laterally adjacent to the cantilever support arms and the upper support surfaces of the load-bearing shelves are coplanar with the upper walls of the cantilever support arms.

11. The cantilever shelving system of claim 10, wherein each of the side braces includes a first open slot extending to a rear end of the mounting flange, the first open slot terminating in an offset portion.

12. The cantilever shelving system of claim 11, wherein each of the side braces further includes a second open slot having a terminal end; and wherein the second open slot is below the first open slot.

13. The cantilever shelving system of claim 12, wherein each of the vertical support members comprise a plurality of vertically spaced-apart hanger pins that extend outwardly from one or both of opposing lateral sides of the vertical support member; and wherein the first and second open slots are sized to accommodate and engage the hanger pins.

14. A cantilever shelving system comprising:

a frame structure comprising a plurality of vertical support members, a lateral support structure interconnecting the vertical support members, and a base;

a cantilever shelf support structure mounted to the frame structure; and a plurality of generally rectangular, load-bearing shelves supported by the cantilever shelf support structure and the frame structure, wherein each of the shelves comprises an upper support surface and a plurality of mounting collars, wherein a mounting collar of said plurality of mounting collars is located near each corner of each shelf;

wherein the base comprises a plurality of base supports, wherein each base support is attached near a lower vertical end of a corresponding vertical support member of said plurality of vertical support members;

wherein each base support comprises:

a horizontal support leg extending along a longitudinal axis from a proximal end adjacent to the corresponding vertical support member to a distal end and comprising an upper side, wherein the horizontal support leg forms an angle of approximately ninety degrees with the corresponding vertical support member; and a vertical support foot extending vertically downward from the distal end of the horizontal support leg;

wherein the plurality of base supports comprise a plurality of first base supports and at least one second base support; wherein the plurality of first base supports are mounted on at least two vertical support members of said plurality of vertical support members at a first vertical height so that the upper sides of the horizontal support legs of the plurality of first base supports lie in a first horizontal plane above a ground surface; and wherein the at least one second base support is mounted on at least one of the plurality of vertical support members at a second vertical height so that the upper side of the horizontal support leg of the at least one second base support lies in a second horizontal plane above the ground surface;

wherein the second horizontal plane is beneath the first horizontal plane;

wherein the cantilever shelf support structure comprises:

a plurality of horizontally extending cantilever support arms, wherein a corresponding cantilever support arm of said plurality of cantilever support arms is mounted to each of the vertical support members; and a plurality of shelf support fittings, at least two shelf support fittings of said plurality of shelf support fittings mounted to each of the cantilever support arms;

wherein the shelf support fittings are inserted within corresponding mounting collars of said plurality of mounting collars of the load-bearing shelves; and wherein laterally adjacent shelves of said plurality of load-bearing shelves are positioned laterally adjacent to a common cantilever support arm of said plurality of cantilever support arms and the shelf support surfaces of said laterally adjacent shelves are coplanar with a planar upper wall of the common cantilever support arm; and wherein ends of the laterally adjacent shelves do not overlap with a front side of a corresponding vertical support member of said plurality of vertical support members to which the common cantilever support arm is mounted; and wherein two of the plurality of first base supports are separated by a first width defining a space therebetween; wherein the space is configured to accommodate a piece of commercial equipment having a second width greater than at least half of the first width such that the piece of commercial equipment is received in the space with one of the at least one second base support being located beneath the piece of commercial equipment.

15. The cantilever shelving system of claim 14, wherein each cantilever support arm comprises:

an elongated portion extending from a proximal end to a distal end along a longitudinal axis and having opposing side walls; and a mounting flange located at the proximal end and including opposing side braces spaced laterally apart to enable the mounting flange to receive and be mounted on a corresponding vertical support member of said plurality of vertical support members; and at least two slots included in each of the side walls, wherein at least one slot of said at least two slots is near the proximal end and at least one slot of said at least two slots is near the distal end;

wherein each shelf support fitting comprises:

a mounting portion comprising at least one mounting tab and at least one lock notch; and a support portion comprising an upward projection laterally offset from the mounting portion; and wherein the at least one mounting tab is inserted into one of the at least two slots and engages an inside surface of a corresponding side wall of said opposing side walls of each cantilever support arm above the one slot and the lock notch engages a lower end of the one slot.

* * * * *